United States Patent [19]

Raschle

[11] 4,240,248

[45] Dec. 23, 1980

[54] DEVICES FOR TEXTURING YARNS BY IMPARTING FALSE TWIST BY FRICTION

[75] Inventor: Josef Raschle, Butschwil, Switzerland

[73] Assignee: Heberlein Maschinenfabrik AG, Watwil, Switzerland

[21] Appl. No.: 79,367

[22] Filed: Sep. 27, 1979

[30] Foreign Application Priority Data

Sep. 27, 1978 [CH] Switzerland ..... 10064/78
Jul. 4, 1979 [CH] Switzerland ..... 6275/79

[51] Int. Cl.[3] ..... D02G 1/04

[52] U.S. Cl. ..... 57/338; 57/348; 57/339

[58] Field of Search ..... ..... 57/334, 337, 338, 339, 57/343, 348, 89, 104, 105, 279, 280

[56] References Cited

U.S. PATENT DOCUMENTS

| | | | |
|---|---|---|---|
| 3,385,047 | 5/1968 | Schwabe | 57/104 X |
| 3,530,659 | 9/1970 | Parker | 57/105 |
| 3,885,378 | 5/1975 | Schuster | 57/339 |
| 4,047,374 | 9/1977 | Venot | 57/348 X |
| 4,060,967 | 12/1977 | Lorenz | 57/104 X |
| 4,124,974 | 11/1978 | Taylor | 57/339 |

*Primary Examiner*—Donald Watkins
*Attorney, Agent, or Firm*—Larson, Taylor and Hinds

[57] ABSTRACT

A friction false twist device is of the type comprising three parallel shafts located at the corners of an equilateral triangle, and carrying rotationally symmetric friction elements. At least one of the shafts can be shifted in relation to the other shaft or shafts so as to open the device for threading. An additional shaft is arranged in relation to the three shafts carrying the friction elements so that, if connected by a line, the centers of the four shafts preferably would lie at the corners of a generally kite-shaped quadrilateral. Each of the four shafts carrys a whorl, the four whorls being drivingly interconnected by an endless belt of relatively minimum elasticity. At least one other shaft is coupled with said shiftable shaft for conjoint movement such that changes in the circumferential length of the quadrilateral caused by movement of the shiftably mounted shaft are substantially compensated by conjoint movement of the coupled shaft. Accordingly, shifting from working positions to threading-up positions results in no more than a minimum modification of the belt length, thus permitting the use of belts having minimum elasticity and support structure.

8 Claims, 6 Drawing Figures

Fig. 4
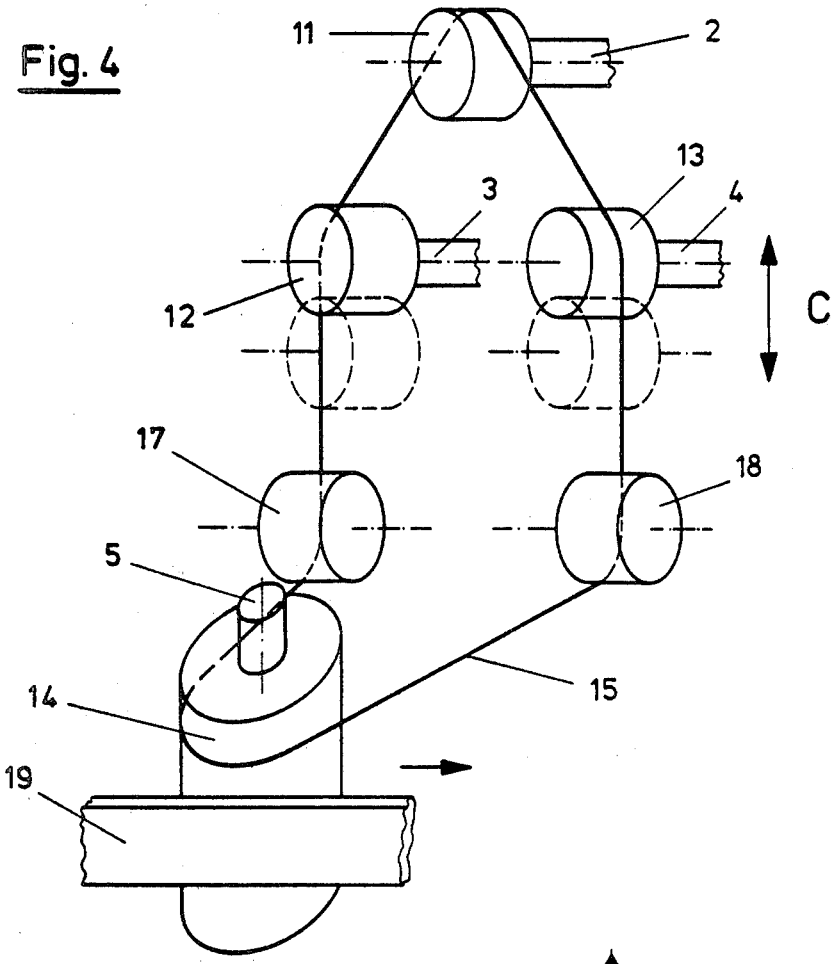
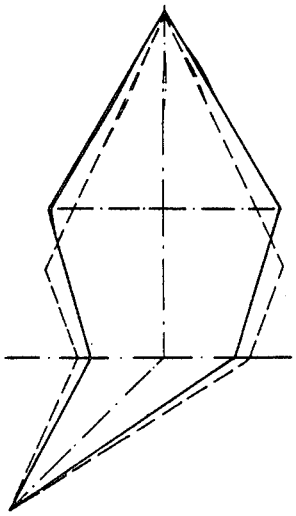
Fig. 5

DEVICES FOR TEXTURING YARNS BY IMPARTING FALSE TWIST BY FRICTION

FIELD OF THE INVENTION

This invention relates to devices for texturing textile yarns of synthetic material by imparting false twist by friction, typically referred to as friction false twist devices.

BACKGROUND AND SUMMARY OF THE INVENTION

Friction false twist devices of this type are well-known, generally comprising three rotatable shafts, each being provided with at least one rotationally symmetric friction element. A top view of the three shafts shows they form the corners of an equilateral triangle when in their operating or working positions, the shafts being individually adjustable, and the yarn to be false-twisted running between the friction elements. The three shafts can be shifted individually or collectively from their working positions into threading-up positions, as shown in German AS No. 2 213 147, correspondng to British Pat. No. 1,376,272. Each of the three shafts can be provided with a whorl, one of the shafts being coupled to a drive motor, and the others indirectly driven through an elastic O-ring linking all whorls. Another well-known device is driven through gears mounted on the shafts and meshing with cogged belts, as shown in Swiss Pat. No. 591,578, corresponding to U.S. Pat. No. 3,932,985. In the device of this latter patent, the belt is actually driven by a fourth shaft, the cogged belt passing around gears on each of the four shafts.

I consider that the disadvantage of the elastic and cogged belts is that they are not well-suited to the very high speeds that are required for modern false-twist friction texturing devices. For instance, with elastic belts, power transmission frequently is not constant in time, slippage is caused by stretch, and service life can be very limited. With cogged belts, relatively small gears, with correspondingly fine pitch, must be employed owing to space limitations. A relatively high belt tension must also be selected, sometimes at the expense of achieving continuous precision meshing of belt and gears.

The object of the present invention is to avoid some or all of the aforementioned shortcomings by providing a drive for the individual shafts of a friction false-twist texturing device of the type described above, which is of relatively simple design, and at the same time serves to transmit torque reliably.

In general, these objects are met in the preferred embodiments of the invention by the incorporation of an additional shaft provided with a whorl and arranged in relation to the shafts carrying the friction elements so that lines connecting the centers of the four shafts preferably form a kite-shaped quadrilateral, with one pair of opposing shafts capable of shifting in relation to the other pair between working and threading-up positions, and with an endless belt of minimum elasticity linking the whorls of all shafts.

The advantage of this preferred solution is that the relative shifting of either pair of opposing shafts forming the kite-shaped quadrilateral for the purpose of threading-up calls for only a minimum modification of the belt length, if any. Thus, this feature permits the use of belts having minimum elasticity and support structure, thereby assuring that the power transmission is constant over a given period of time, and that service life of the belt is extended, even at very high speeds. While this is the preferred arrangement, the basic principal is to arrange the shiftable shafts such that any belt lengthening tendency upon the shifting of one shaft is substantially compensated by the conjoint shifting of the other shaft, in combination with the overall configuration of the shaft centers and the belt path. In the preferred arrangements, the configuration formed by the shafts and the selection of the movable shafts and their directions of movement are such that any belt-lengthening tendency stemming from the movement of one of the movable shafts is minimized.

Preferably a pair of shafts carrying friction elements at opposite corners of the kite-shaped quadrilateral are shifted in relation to the other pair of shafts, which may be fixed. The additional shaft can be either parallel or vertical to the shafts carrying the friction elements, the vertical application involving the use of guide rolls between the whorls.

BRIEF DESCRIPTION OF THE DRAWINGS

The invention is illustrated in diagramatic detail in the accompanying drawings, three examples of preferred embodiment being shown. In these schematic representations.

FIG. 4 is a perspective representation of a second embodiment of the invention;

FIG. 5 is a schematic representation of the device in accordance with FIG. 4.

DESCRIPTION OF PREFERRED EMBODIMENTS

Figure 1:
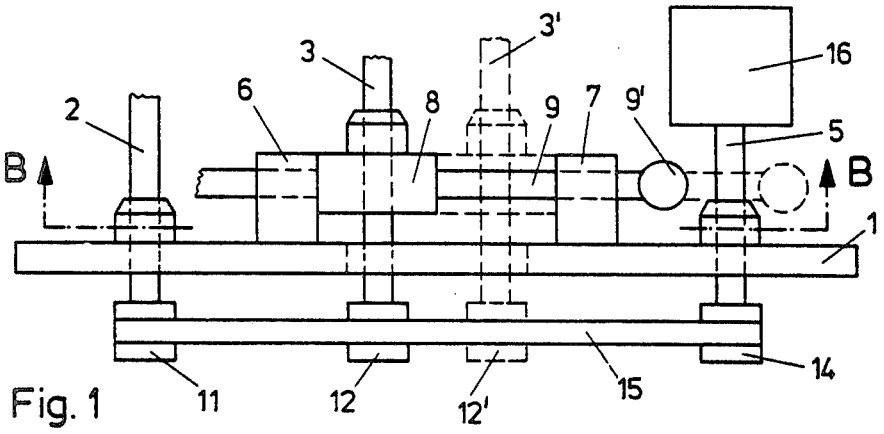
FIG. 1 is an elevation view of the first embodiment.

FIG. 1 shows a base plate (1) supporting shafts (2 and 5), and containing two bearing blocks (6, 7) in which the rods (9, 10) carrying the holding plate (8) are mounted so that they can be slideably adjusted. The two shafts (3, 4) are mounted in the holding plate (8), and pass downwardly through perforations in the base plate (1) formed to permit the sliding adjustment of shafts (3 and 4). The shafts (2, 3 and 4) carry conventional friction elements, not shown in FIG. 1, but schematically illustrated in FIG. 6, on the sections protruding upwardly from the base plate (1).

Figure 2:
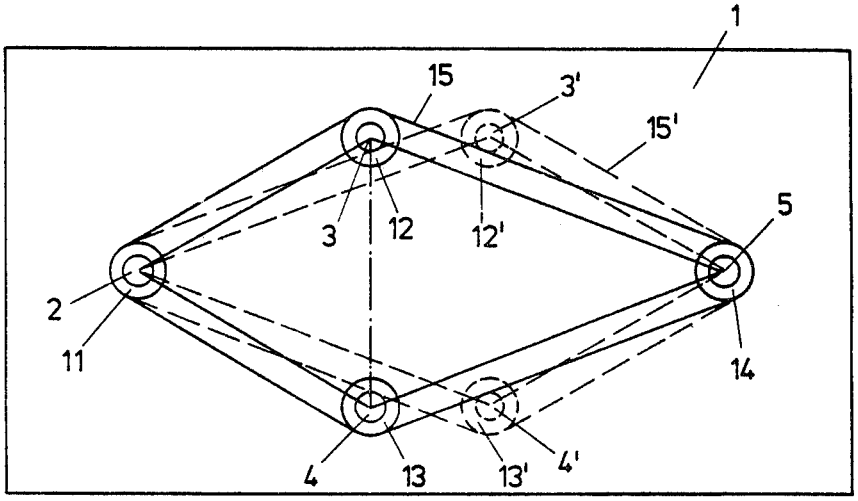
FIG. 2 is an inverted plan view of the device of FIG. 1.

As shown in FIG. 2, the shafts (2, 3, 4 and 5) are arranged in facing parallel relationship, such that lines connecting their centers form a generally kite-shaped quadrilateral, which basically comprises two triangles formed respectively by shafts (2, 3 and 4), and by shafts (3, 4 and 5), the two triangles having a common base defined between shafts (3 and 4). Mounted on the sections of each of the shafts (2, 3, 4 and 5) extending downwardly from the base plate (1) are respective whorls (11, 12, 13 and 14) in contact with an endless belt (15). Coupled to that section of shaft (5) protruding upwardly from base plate (1) is an electric motor (16) serving to drive this shaft, and hence the other shafts through the endless belt (15).

Figure 3:
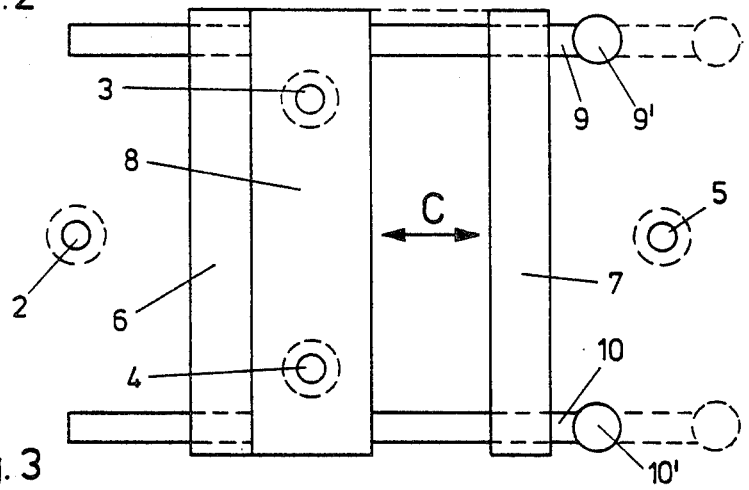
FIG. 3 is a view taken along line B—B in FIG. 1.

As shown in FIG. 3, the holding plate (8) with shafts (3 and 4) can be shifted with the aid of levers or handles (9', 10') on the rods (9, 10) in the direction indicated by the double arrow (C), the working position being represented by unbroken lines, and the non-working or threading-up position by dash lines. In the working position, the lines connecting the centers of shafts (2, 3 and 4) form an equilateral triangle, as is conventional in the art. When the shafts (3 and 4) are shifted from their working to non-working positions, and vice-versa, as illustrated in FIG. 2, the shafts (3 and 4) with the whorls (12 and 13, change their positions (3', 4', 12', 13') without materially affecting the length of the belt (15). It is therefore possible to employ a belt (15) having minimum elasticity and support structure. In the particular embodiment of FIGS. 1–3, and as best shown in FIG. 2, the kite-shaped quadrilateral is unsymmetrical about the line connecting shafts (3 and 4), and the shifting of shafts (3 and 4) as shown in FIG. 2 substantially reverses the unsymmetrical configuration, such that the circumferential length of the quadrilateral is not materially changed. It will be appreciated that substantially the same result could be achieved by shifting movement of shafts (2 and 5) together, since it is only the relative shifting movement that is important.

In the embodiment illustrated in FIG. 4, the shafts (2, 3 and 4) with whorls (11, 12 and 13) are horizontally disposed, and are supported by a vertical base plate and a sliding holding plate, not shown, as in the embodiment of FIGS. 1–3. On the other hand, the shaft (5) of FIG. 4 is vertical, and the endless belt (15) is guided by whorls (12, 13) around or through guide rolls (17 and 18) to whorl (14) on shaft (5).

FIG. 5 illustrates highly diagramatically and in perspective the effect of shifting shafts (3 and 4) in a typical embodiment generally in accordance with FIG. 4. In the embodiment of FIG. 4, the location of shaft (15) can be centered or off-centered relative to the other shafts such that the resulting quadrilateral can be unsymmetrical about one or both axes. A drive belt (19) can be used to drive whorl (14).

When an electric drive motor is coupled to the additional shaft, such as shaft (5), provided with a whorl but not carrying a friction element, placement can be a problem in that it is desirable to place the shaft near the sliding shafts, but depending upon the diameter of the friction elements and the electric motor, this could prevent these shafts from being shifted fully from their working to non-working positions. In accordance with a further embodiment of the invention, this is avoided by providing sufficient space between the fixed shaft carrying a friction element and the additional fixed shaft carrying a drive motor, this spacing being at least 2.5 times the matching space between the shafts carrying the friction elements in their working positions, and also by the incorporation of guide rolls for the endless drive belt between the whorls on the slide shafts and the whorl on the additional fixed shaft, respectively. Both fixed shafts may preferably be spaced so that the distance equals 3 to 4.5 times the corresponding distance between the shafts carrying the friction elements in their working position. This is successful in maintaining relatively large clearance between the additional fixed shaft, to which the electric motor is coupled, and the opposing fixed shaft so that the other two shafts, each carrying a friction element, can be shifted with ease from their operating to non-operating positions.

Figure 6:
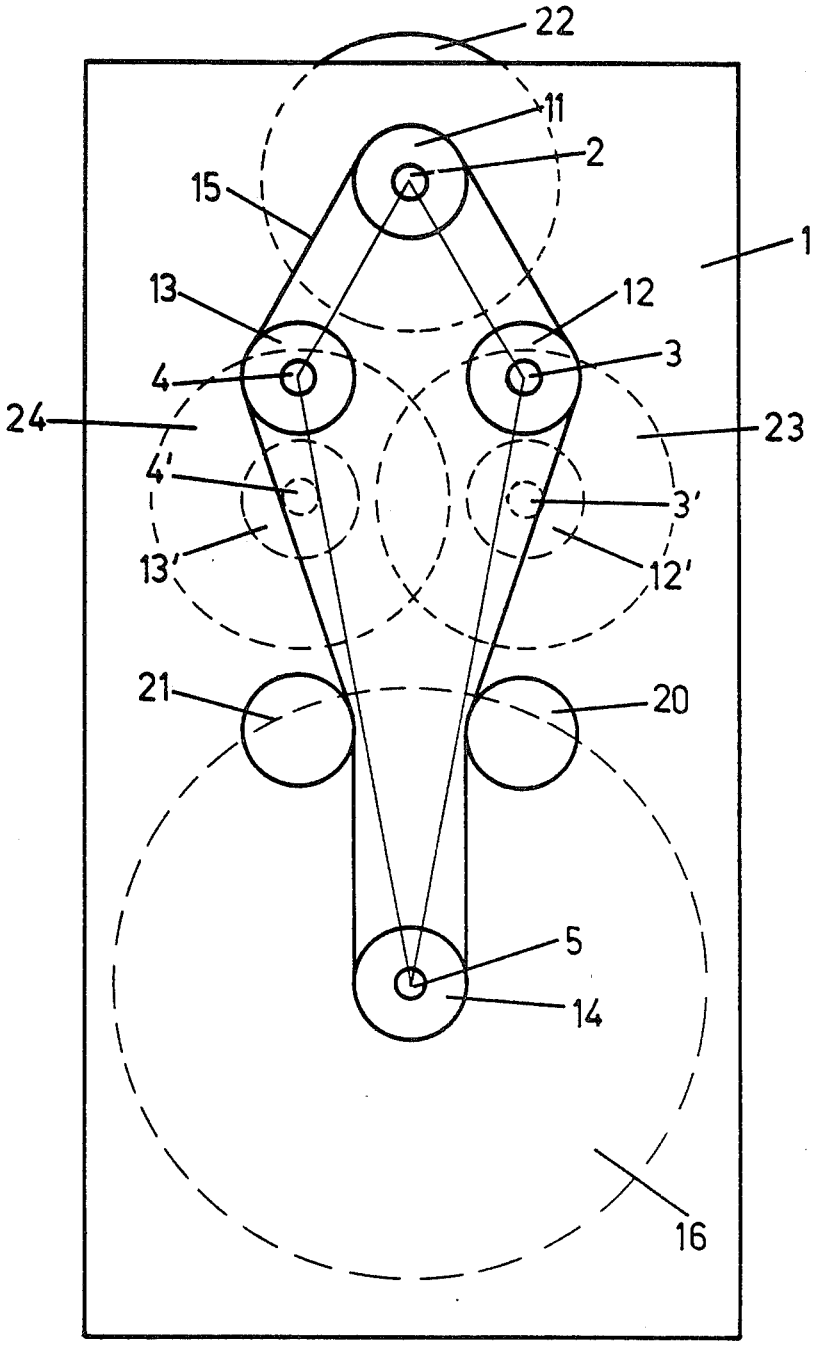
FIG. 6 is an inverted plan view of a third embodiment.

A typical embodiment in keeping with the foregoing discussion is illustrated in FIG. 6, which shows a base plate (1) supporting both fixed shafts (2 and 5). Locating on the top of the base plate (1) is a sliding holding plate, not shown, in which both sliding shafts (3 and 4) are mounted, as in FIG. 1, the sliding shafts being guided downwardly through perforations in the base plate (1). The shafts (2, 3, 4) carry friction elements (22, 23, 24) on the shaft sections protruding upwardly from the base plate (1). Mounted on the downwardly extending sections of shafts (2, 3, 4, 5) are whorls (11, 12, 13, and 14), about which the endless belt (15) extends. Coupled to the upwardly extending section of shaft (5) is an electric motor (16) for driving the shaft. The clearance between shaft (5) and shaft (2) corresponds to approximately four times the corresponding clearance between shafts (2, 3 and 4) in their working positions. For applying the necessary tension and whorl engagement to drive belt (15), the guide rolls (20 and 21) are located between whorls (12 and 13), on the one hand, and whorl (14) on the other.

The sliding shafts (3, 4) with whorls (12, 13) are represented in FIG. 6 in their working positions by unbroken lines, and in their non-working positions by broken lines (3', 4', 12', 13'), the threading-up state corresponding to this latter position.

It can be seen that with the illustrated arrangement, the shafts (3, 4) can be shifted from their working to non-working positions without impedance by the electric motor (16) and the friction elements (23, 24).

Having thus described and illustrated preferred embodiments of my invention, I claim:

1. A device for texturing textile yarns by imparting false twist by friction, comprising three parallel shafts for carrying rotationally symmetric elements between which, in operation, a yarn can be run to be false-twisted, said shafts being located at the corners of an equilateral triangle in their operative positions, at least one of said shafts being shiftably mounted for movement between its operative position and a threading-up position in which it is located relatively away from at least one of the other shafts, at least one further shaft arranged in relation to said three shafts such that the centers of all shafts, if connected by a line, would form corners of a closed figure of at least four sides, two sides of which are sides of said equilateral triangle, means coupling said shiftably mounted shaft with another of the shafts for conjoint movement such that any changes in the circumferential length of said closed figure tended to be caused by movement of said shiftably mounted shaft are substantially compensated by conjoint movement of the coupled shafts, each of said shafts being provided with a whorl, and a substantially in-elastic endless belt drivingly linking the whorls of all shafts.

2. Apparatus as claimed in claim 1 wherein said at least one further shaft is a single fourth shaft located such that the centers of the four shafts lie at the corners of a generally kite-shaped quadrilateral, and the conjointly movable shafts comprise a pair of opposing shafts lying at opposite corners of the quadrilateral.

3. Apparatus as claimed in claim 2 wherein the pair of movable shafts comprise two of the shafts carrying friction elements, the movable shafts moving together in the same direction and to the same extent generally in the direction of a line connecting the centers of said further shaft and the third of said three shafts.

4. Apparatus as claimed in claim 3 wherein said further shaft and the third shaft carrying friction elements are fixed.

5. Apparatus as claimed in claim 2 wherein all four of said shafts are parallel.

6. Apparatus as claimed in claim 2 wherein said fourth shaft is substantially normal to said three shafts, and further including idler guides for the endless belt between said fourth shaft and the adjacent two shafts.

7. Apparatus as claimed in claim 5 wherein the spacing between said fourth shaft and the oppositely disposed one of said three shafts is at least 2.5 times the corresponding distance between each pair of said three shafts in their working positions, and further comprising idler guides for said endless belts located between the whorls on said fourth shaft and the adjacent two of said three shafts.

8. Apparatus as claimed in claim 7 wherein said spacing is from 3 to 4.5 times said corresponding spacing.

* * * * *